US005982264A

United States Patent [19]

Nakao et al.

[11] Patent Number: 5,982,264

[45] Date of Patent: Nov. 9, 1999

[54] HIGH FREQUENCY SHEET-TYPE TRANSFORMER

[75] Inventors: Fumiaki Nakao; Satoshi Ohta; Shinji Watanabe; Tetsuya Suzuki; Mikio Kitaoka, all of Minato-ku, Japan

[73] Assignee: FDK Corporation, Tokyo, Japan

[21] Appl. No.: 09/094,477

[22] Filed: Jun. 10, 1998

[30] Foreign Application Priority Data

Aug. 20, 1997 [JP] Japan ..... 9-223246

[51] Int. Cl.[6] ..... H01F 5/00

[52] U.S. Cl. ..... 336/200; 336/232; 336/173

[58] Field of Search ..... 336/200, 222, 336/223, 232, 173

[56] References Cited

FOREIGN PATENT DOCUMENTS

| | | |
|---|---|---|
| 369965 | 5/1919 | Germany . |
| 5-315153 | 11/1993 | Japan . |
| 156609 | 8/1963 | Russian Federation . |
| 772528 | 4/1957 | United Kingdom . |

*Primary Examiner*—Lincoln Donovan
*Assistant Examiner*—Tuyen T. Nguyen
*Attorney, Agent, or Firm*—Wenderoth, Lind & Ponack, L.L.P.

[57] ABSTRACT

A high frequency sheet-type transformer coil structure capable of minimizing eddy current generated by parallel winding and raising power conversion efficiency when the high frequency sheet-type transformer uses sheet-like coils arranged such that a coil on a first surface and a coil on a second surface have a reverse winding order.

4 Claims, 3 Drawing Sheets

HIGH FREQUENCY SHEET-TYPE TRANSFORMER

BACKGROUND OF THE INVENTION

1. Field of the Invention

The present invention relates to a high frequency transformer which is widely and extensively utilizable as a high frequency transformer used in a high frequency range such a TV broadcasting frequency range and a power transformer for switching power source, and more particularly to a plane transformer (sheet-type transformer).

2. Description of the Related Prior Art

In the high frequency transformers of the type described above, in order to avoid a skin effect and a proximity effect, large-diameter wire cannot be adopted. Accordingly, an attempt has been made to provide and use of the parallel winding of a thin and fine wire. Additionally, in recent years, use of the sheet-like coil has been a general trend with a progress and development of the conductive pattern production technique.

However, in a conventional structure, as shown in FIG. 6, the same arrangements are adopted on surfaces A and B and, because of an influence of leaking magnetic flux in magnetic field near a gap (g) at the center leg of EI core, a difference in induced voltage is generated between the coils "a" and "b", so that a loss due to ring current (eddy current), which has not previously been regarded as so important, is increased.

That is, in a coil region of a transformer, the magnetic flux physically linking differs between the aforementioned coils "a" and "b", so that eddy current circulated to the coils "a" and "b" is generated.

SUMMARY OF THE INVENTION

Accordingly, the present invention is proposed to solve the above problem, and it is therefore an object of the present invention to provide an improved sheet-type transformer comprising sheet-like coils, capable of reducing eddy current as much as possible and raising power conversion efficiency thereof.

In a sheet-type transformer of the present invention, coils on first and second surfaces are arranged reversely in winding order. That is, according to the present invention there is provided a high frequency sheet-type transformer using sheet-like coils wherein coils are arranged so that a coil on a first surface is in a reverse relation in winding direction with respect to a coil on a second surface. Namely, the coils are reverse in winding order.

DESCRIPTION OF THE PREFERRED EMBODIMENTS

Figure 1:
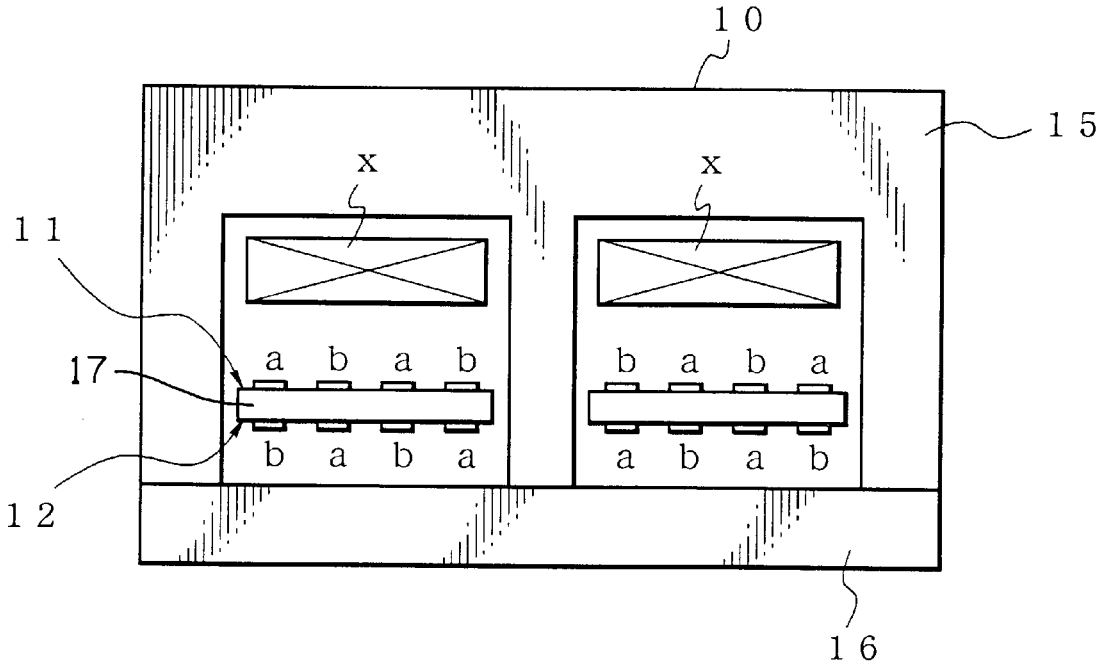
FIG. 1 is an explanatory view of an EI core transformer, showing a coil arrangement and magnetic field of an EI core sheet-type transformer in which an E-type core and an I-type core are combined according to a preferred embodiment of the present invention.
Figure 2:
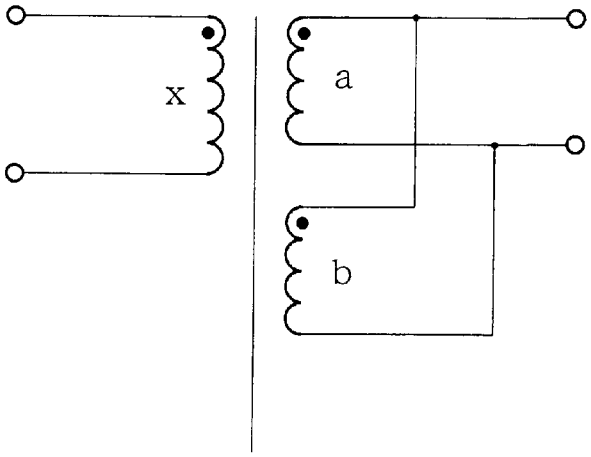
FIG. 2 is a circuit diagram showing coils of a transformer of FIG. 1.
Figure 3:
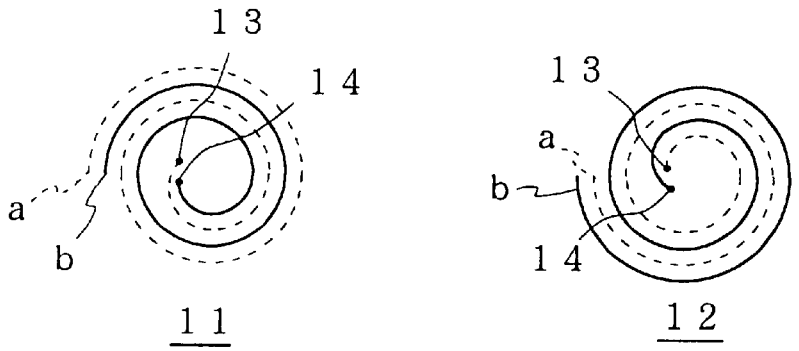
FIG. 3 is a view showing structures of coils of the present invention shown in FIGS. 1 and 2.

FIG. 1 shows a section of a so-called EI transformer 10 comprising an E-type core ("E" shaped core) 15 and an I-type core ("I" shaped core) 16. FIG. 2 is a circuit diagram of the structure of FIG. 1. FIG. 3 is an explanatory view showing structures of coils of FIG. 1, and a surface A, i.e., 11, and a surface B, i.e., 12, in FIG. 3 are those seen from above (surface 12 is viewed from above through surface 11 and substrate 17).

In FIGS. 1, 2 and 3, the transformer 10 has a substrate 17 with a first surface 11 (surface A) and a second surface 12 (surface B). As shown in FIG. 1, the first surface 11 has an arrangement of "a, b, a, b" from outside toward inside and the second surface 12 has an arrangement of "b, a, b, a" from outside toward inside in contrast with that on the first surface. The coil "a" on the first surface is electrically connected to the coil "a" on the second surface and similarly the coil "b" on the first surface to the coil "b" on the second surface respectively via through-hole 13, 14.

Incidentally in FIG. 1, the symbol "x" denotes a primary coil portion and corresponds to a primary coil "x" in FIG. 2.

In this manner, as to a secondary coil, the coil position on the first surface (surface A) and that on the second surface (surface B) are reverse in winding order or direction.

Table 1 below shows a result of flux linkage analysis obtained by comparing flux linkage ($\mu$ Wb) provided by a structure of the present invention in which the arrangements of the secondary coils "a" and "b" of parallel winding in the sheet-type transformer are reverse on the first surface (surface A) and second surface (surface B) and flux linkage ($\mu$ Wb) by a conventional structure in which the arrangements of the coils "a" and "b" are the same on the first surface (surface A) and second surface (surface B).

TABLE 1

| | Arrangements of the secondary coils of parallel winding | | Flux linkage ($\mu$ Wb) coil "a" | Flux linkage ($\mu$ Wb) coil "b" | Difference between coil "a" and coil "b" |
|---|---|---|---|---|---|
| Invention | | | | | |
| surface A | a | b | 57.52 | 57.47 | 0.05 |
| surface B | b | a | | | |
| Prior Art | | | | | |
| surface A | a | b | 57.14 | 57.85 | 0.71 |
| surface B | a | b | | | |

As described above, since the difference in flux linkage on both surfaces can be minimized by reversing the arrangements of the coils on the first and second surfaces, it is possible to suppress generation of eddy current to a minimum level when the parallel winding is adopted.

Figure 4:
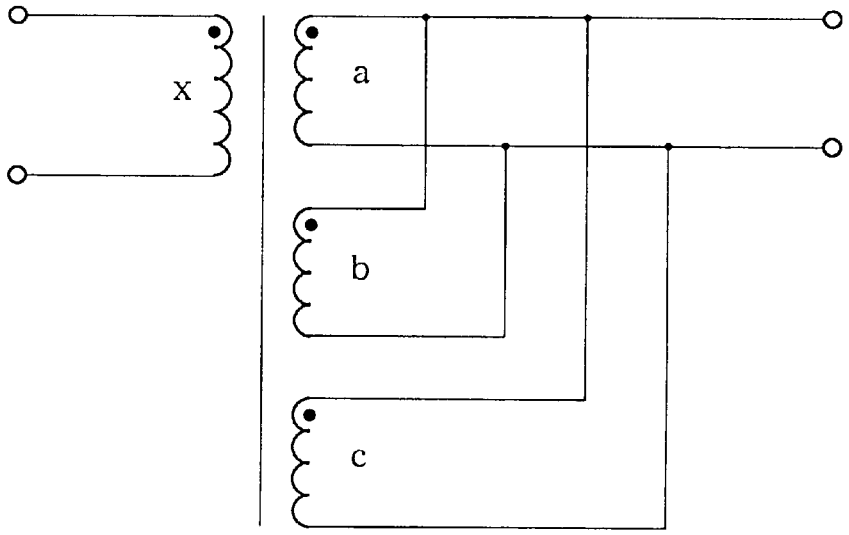
FIG. 4 is a diagram showing a structure of coils according to another embodiment of the present invention.
Figure 5:
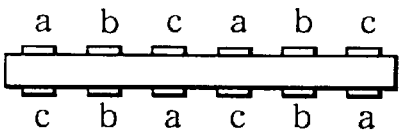
FIG. 5 is an explanatory view showing a coil position structure of FIG. 4.
Figure 6:
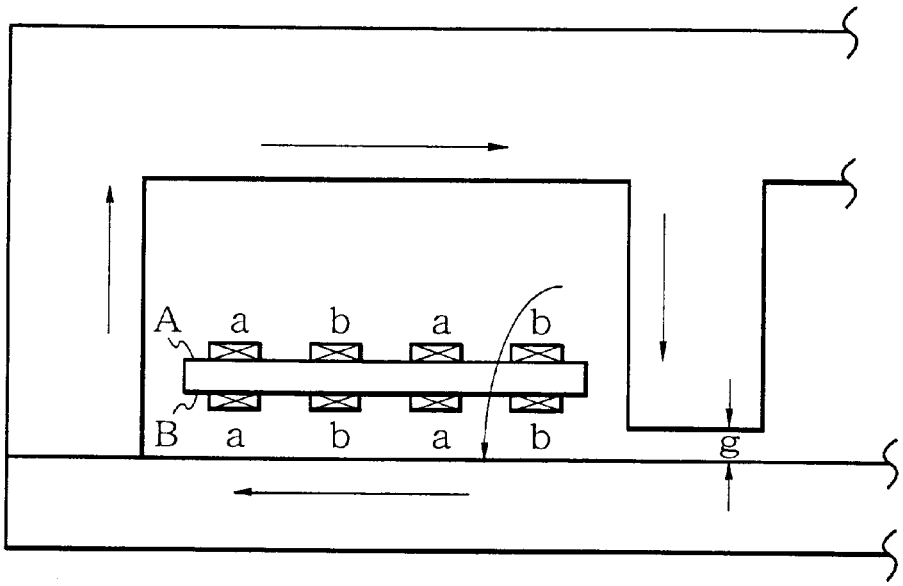
FIG. 6 (PRIOR ART)
FIG. 6 is an explanatory view of an EI core, showing an example of a conventional structure and its magnetic field.
Figure 7:
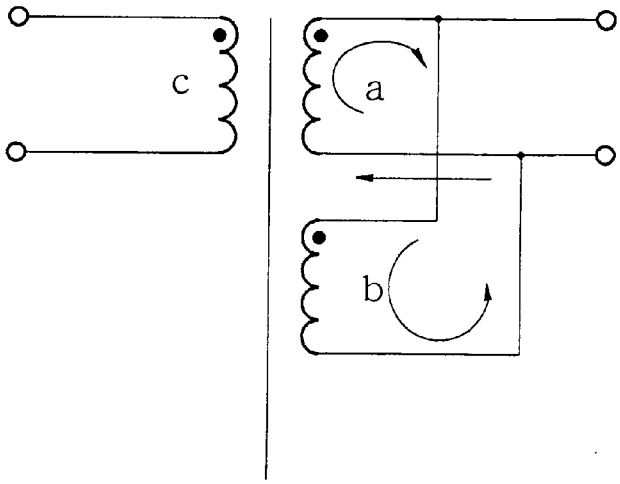
FIG. 7 (PRIOR ART)
FIG. 7 is a diagram showing a circuit structure of FIG. 6.

Although FIGS. 1–3 show an example of two coils "a" and "b" of parallel winding, it is possible to form a parallel winding structure of three or more coils as shown in FIGS. 4 and 5.

FIGS. 4 and 5 show an example of the parallel winding structure containing coil "c" besides the coils "a" and "b".

Also in this embodiment, the coil structure on the first surface and that on the second surface are reverse to each other. The arrangement of "a, b, c, a, b, c" from outside on the first surface is reversed on the second surface as the arrangement of "c, b, a, c, b, a", as illustrated in FIG. 5.

Although the above described embodiments refer to the high frequency transformer composed of EI core, the present invention is not restricted thereto, but it is needless to say that the invention is adopted in a frequency transformer having a core other than the EI core. Further, if the need arises, the invention can be adopted also in a coil part of, for example, an inductor or the like other than a transformer.

Since the sheet-type transformer of the present invention is composed as described above, electromagnetic balance can be obtained at the respective coils ( "a", "b" or the like) even in coils for high frequency large-current, so that a loss due to the skin effect and proximity effect is suppressed, thereby minimizing the loss.

What is claimed is:

1. A high frequency sheet-type transformer comprising:

a substrate including a first surface and a second surface opposite to said first surface;

a plurality of sheet-like coils, connected in parallel, each including windings, wherein said windings of said plurality of coils are arranged in a first alternating winding order on said first surface such that said windings of one of said coils are between said windings of another of said coils, and said windings of said plurality of coils are arranged in a second alternating winding order on said second surface, reverse in order than the first winding order, such that said windings of said one of said coils on said first surface correspond in a position to said windings of said another of said coils on said second surface and said windings of said another of said coils on said first surface correspond in a position to said windings of said one of said coils on said second surface.

2. A high frequency sheet-type transformer as claimed in claim 1, wherein said high frequency transformer is an EI core transformer comprising an E-type core and an I-type core combined with said E-type core.

3. A high frequency sheet-type transformer as claimed in claim 1, wherein said coils are wound parallel.

4. A high frequency sheet-type transformer as claimed in claim 1, wherein said plurality of coils includes three coils.

* * * * *